United States Patent [19]

Ralph

[11] Patent Number: 4,702,055

[45] Date of Patent: Oct. 27, 1987

[54] GRILL STRUCTURE

[76] Inventor: James L. Ralph, 665 Grove Ave., Shoreview, Minn. 55112

[21] Appl. No.: 739,887

[22] Filed: May 31, 1985

[51] Int. Cl.[4] ..... E04B 1/48; E04B 1/68

[52] U.S. Cl. ..... 52/456; 52/507; 52/664

[58] Field of Search ..... 52/456, 664, 665, 666, 52/667, 668, 106, 202, 203, 484, 507

[56] References Cited

U.S. PATENT DOCUMENTS

| | | | |
|---|---|---|---|
| 15,578 | 8/1856 | Sessions | 52/456 |
| 587,631 | 8/1897 | York | 52/668 X |
| 1,117,053 | 11/1914 | Humphries . | |
| 1,657,908 | 1/1928 | Wulftange . | |
| 1,814,317 | 7/1931 | Lebherz . | |
| 2,682,326 | 6/1954 | Fitzgerald | 52/667 X |
| 2,728,388 | 12/1955 | Noecker . | |
| 3,099,865 | 8/1963 | Burnett | 52/456 X |
| 3,340,661 | 9/1967 | Krieger . | |
| 3,358,412 | 12/1967 | Martin . | |
| 3,386,219 | 6/1968 | Beil . | |
| 3,474,587 | 10/1969 | Martin | 52/456 |
| 3,645,058 | 2/1972 | Jacobson et al. | 52/456 |
| 3,946,531 | 3/1976 | Armstrong | 52/456 |
| 4,037,383 | 7/1977 | Debold et al. | 52/664 |

*Primary Examiner*—William F. Pate, III
*Assistant Examiner*—R. Chilcot
*Attorney, Agent, or Firm*—Leo Gregory

[57] ABSTRACT

A grill structure for use in connection with a combination screen and storm door, the grill being formed of vertical and horizontal channel members, the horizontal members comprising segments spacing the vertical members, rods extending through the channels of the horizontal members, the channels each having a rib therein and the rods each having a slot therein to receive a rod whereby the rods are non-rotatably disposed through the channels of said horizontal members to secure the framework of the grill, U-channel members from the perimeter of the grill and screws applied through said U-channel members into the ends of said rods secure the structure. The rods are held free from rotation and torsion therealong in securing the screws and the rods need not be held by hand against rotation as the screws are applied.

1 Claim, 6 Drawing Figures

GRILL STRUCTURE

BACKGROUND OF THE INVENION

1. Field of Invention

This invention relates to door and window grill structures.

2. Description of the Prior Art

Grill structures are in common use as protective means particularly in connection with combination screen and storm doors. The grill segments are secured together in various ways.

Traverse rods are commonly used and secured at their respective ends by screws or other means as through perimeter channel or frame members.

In securing the ends of the cross or tie rods which hold the framework of the grill together, one end has to be held against rotation as the other end is being secured as by a screw. This is an awkward handling in assembling the grill structure.

It is desirable to provide means such that in the installation of the rods in being disposed through channels of the frame members, that the rods engaged within the channels to be held against rotation.

SUMMARY OF THE INVENTION

This invention relates to an improvement in the construction of a grill to be used as in connection with a combination screen and storm door.

The particular novelty herein is present in the structure of the means for securing the grill structure together.

It is an object of this invention in the assembly of a grill structure, to provide locking rods which extend through channel members including means in connection with said rods and the passages through said channel members whereby the rods are non-rotatably retained within said passages.

It is a more specific object of this invention in the assembly of a grill to have passages extend through the channel members and through the intersections of said channel members, said passages each having a rib therein and rods therethrough, each having a longitudinal slot therein receiving a rib whereby said rods are retained against rotation.

In connection with the grill structure, the same will have a perimeter such as formed of U-channel members.

These and other objects and advantages of the invention will be set forth in the following description made in connection with the accompanying drawings in which like reference characters refer to similar parts throughout the several views.

DESCRIPTION OF PREFERRED EMBODIMENT

Figure 1:
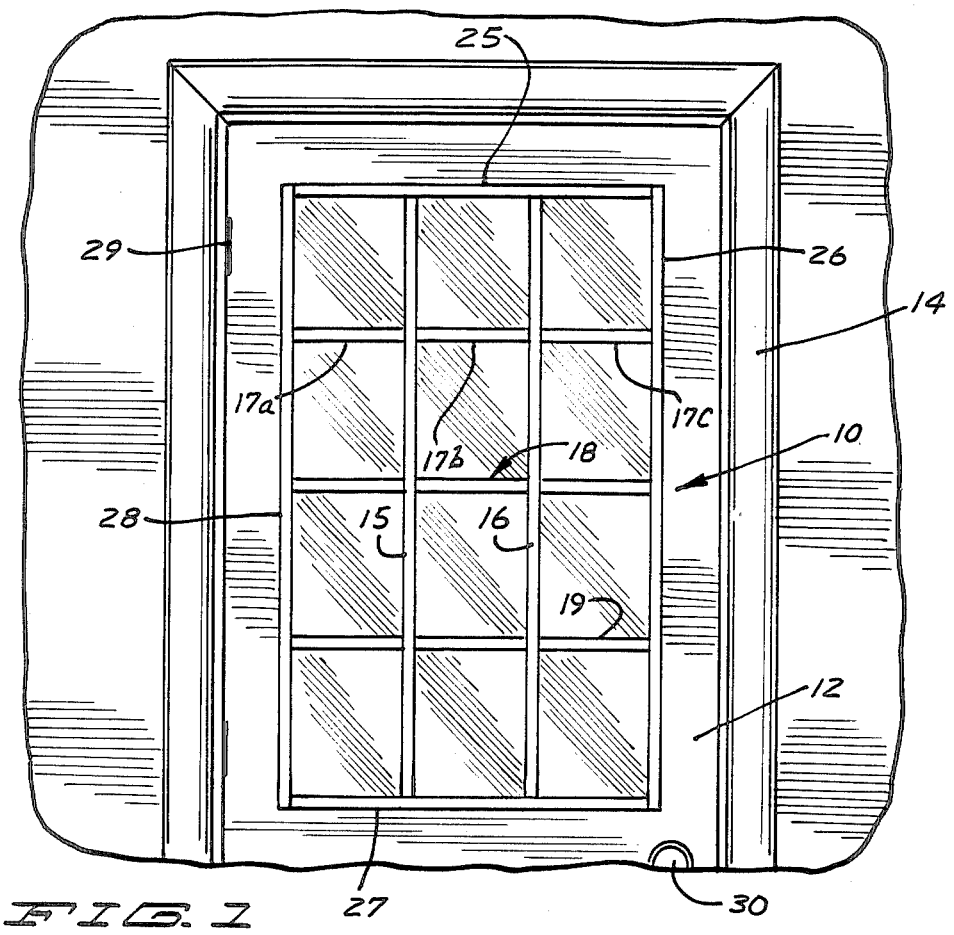
FIG. 1 is a view in front elevation of the structure herein in operating position.

Referring to FIG. 1, the grill structure comprising the invention herein is indicated generally by the reference numberal 10 shown installed upon the upper portion of a combination door 12 which is hung in a frame 14.

The novelty in the grill structure is present in the means used to secure the grill as a frame structure.

The particular embodiment of the grill structure here shown comprises unitary vertical channel members or stiles 15 and 16 and horizontal channel members or rails 17, 18 and 19 which are segmented with the respective segments being represented by 17*a*, 17*b* and 17*c*. The term channel member means a frame member having a channel or passage therethrough.

Forming a perimeter about said grill are U-channel members 25–28.

The door is shown hung by hinges 29 and has a knob 30.

Extending through the horizontal members are connecting or frame securing rods as indicated by the rods 31 and 32 which are shown. The rod 31 will be described as representative of all of the rods.

Figure 2:
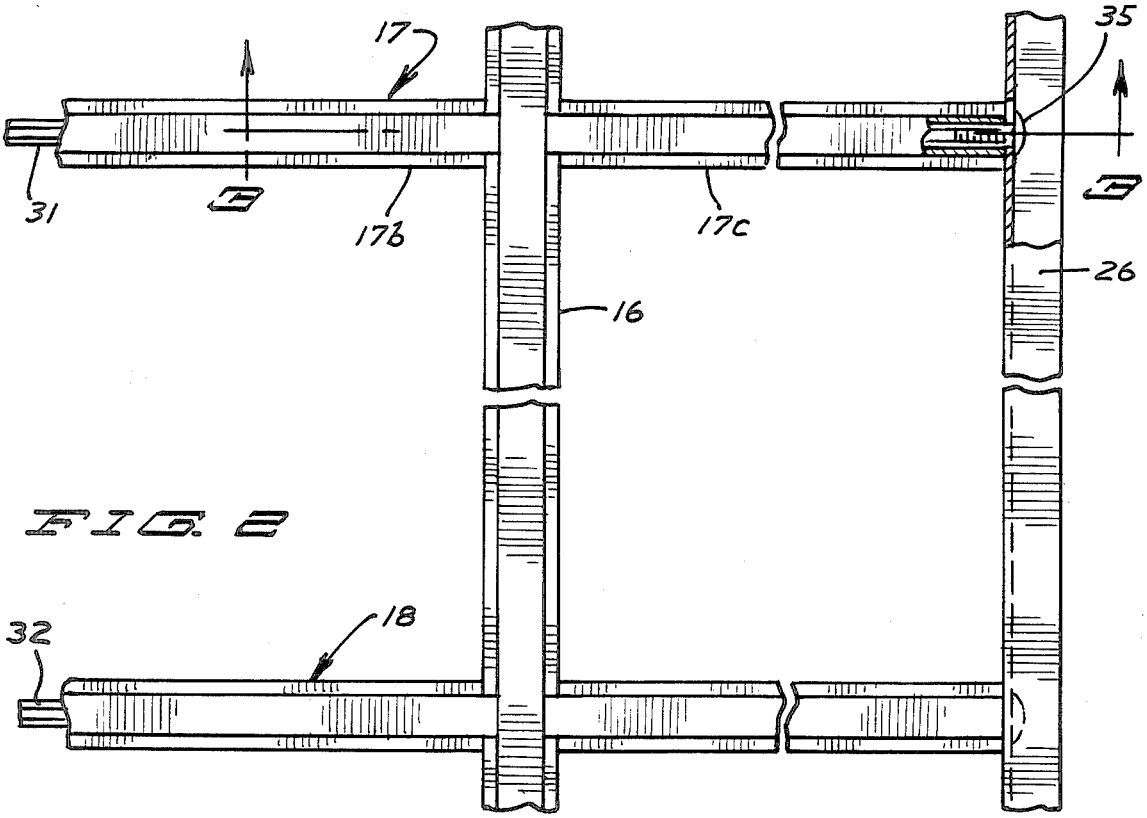
FIG. 2 is a fragmentary view of a detail of structure with some parts in section and some portions broken away.
Figure 3:
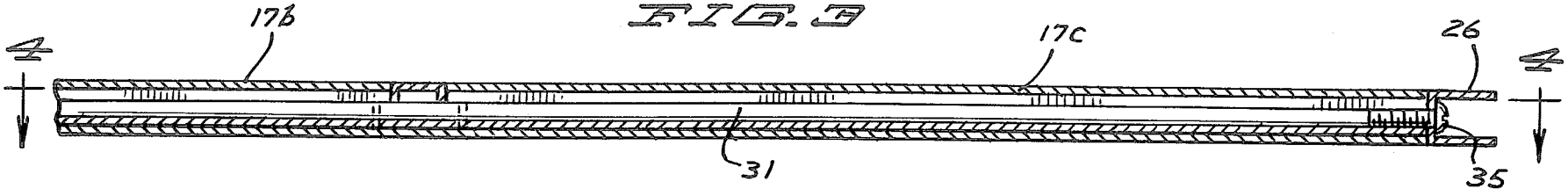
FIG. 3 is a view in horizontal section taken on line 3—3 of FIG. 2 as indicated.
Figure 4:
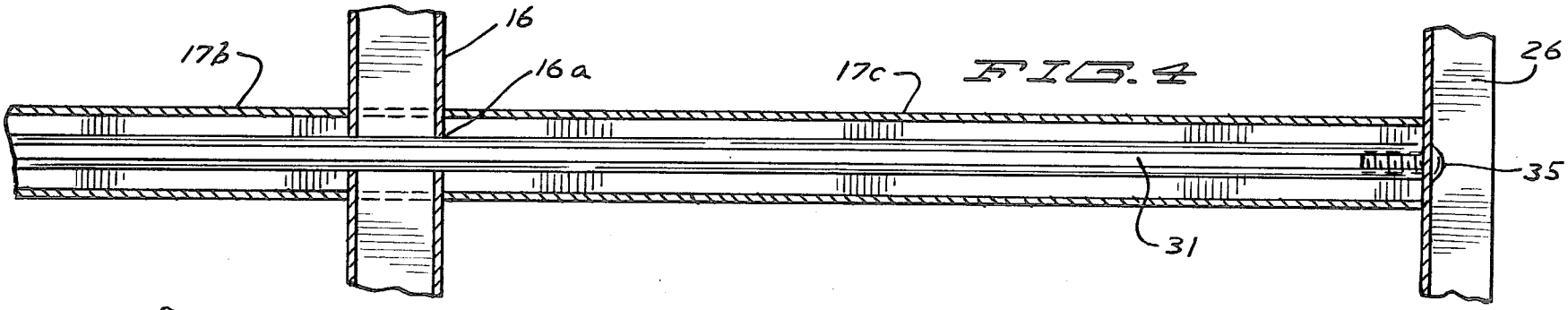
FIG. 4 is a view in horizontal section taken on line 4—4 of FIG. 3 as indicated.

In FIG. 2 the horizontal channel member 17 is shown with its segments 17*b* and 17*c* showing the connecting rod 31 extending therethrough. A portion of said channel segment 17*c* and of channel member 26 is broken away to show a screw 35 exteding through said channel member 26 and into the adjacent end portion of said rod 31.

Figure 6:
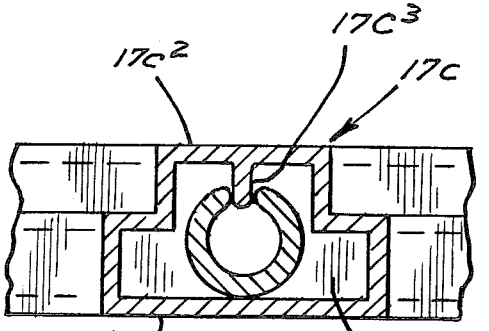
FIG. 6 is a view in vertical section taken on line 6—6 of FIG. 5 as indicated.
Figure 5:
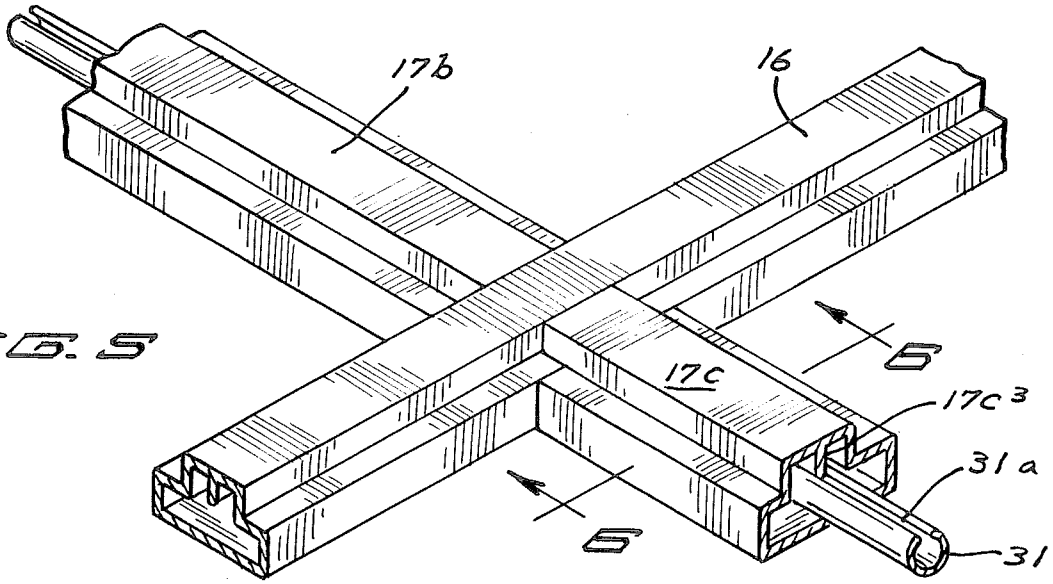
FIG. 5 is a view in perspective showing a detail of structure.

Attention is drawn to FIGS. 5 and 6 and the grill channel segment 17*c* wherein the cross sectional configuration of said channel segment defines a rectangular bottom portion $17c^1 1$ and a like upward projecting portion $17c^2$ of a lesser width with a channel $17c^4$ extending through said segment. Bi-sectioning said channel in said upper segment portion $17c^2$ is a depending rib $17c^3$.

Disposed through the member 17 and extending through the segment 17*c* as shown is the rod member 31. Said rod member has a diameter such that it extends upwardly into said projection $17c^2$.

Said rod as here shown is formed as a C in cross section which provides a longitudinal slot 31*a* the length thereof. Said rod as positioned receives within said slot a depending portion of said rib member $17c^3$. Thus said rod is retained against rotation.

It is to be understood that the rod 31 is shown in a preferred embodiment and that it may take on various other cross sectional configurations, within the scope of this invention, and may be variously non-rotationally retained within the channel member 17.

The vertical members such as member 16 are apertured as at 16*a* to permit the passage of rod 31 therethrough.

Threaded into each end portion of the connecting rods herein as indicated at the end portion of the rod 31 are the self-threading screws 35.

The assembly of the grill structure as described forms a very rigid and strong grill frame structure.

But for the rib $17c^3$, said rod when being secured with a screw 35 at one end would rotate, unless held, at its other end. This would be awkward as the rod is entirely within the channel member. Hence a screw would have to be applied at each end simultaneously which requires the assistance of two persons to assemble the grill structure. It would be very difficult for one person to do this. Further, said rod would be subjected to a full length twisting action by having screws tightened at each end in opposite directions. Torque such as this applied over the length of the rod could possibly distort or weaken the rod.

In the structure as presented, the force of the screw affects the rod only at its end portion and this with the stabilizing rib 17$c^3$ is so negligible that it may be disregarded.

The grill in assembled condition with the perimeter channel members thereabout is mounted into a door or window frame in a customary manner which is not here described.

The ease of making and assembling the parts of the grill herein described results in substantial savings of manufacturing and assembly costs.

It will of course be understood that various changes may be made in the form, details, arrangement and proportions of the product without departing from the scope of the invention which, generally stated, consists in a product capable of carrying out the objects above set forth, such as disclosed and defined in the appended claims.

What is claimed is:

1. A grill structure for a door or window, having in combination a plurality of vertical members, a plurality of horizontal members, one of said plurality of members comprising segments having said other plurality of members therebetween, each of said segments having a channel longitudinally therethrough, each of said channels having a top wall, a rib depending from said top wall of each of said channels, said rib extending normal to a plane defined by said horizontal and vertical members, a rod having a longitudinal slot therein disposed in each of said channels receiving said rib therein thereby being retained against rotation, a perimeter member enclosing the ends of said vertical and horizontal members, and fastening means extending into the ends of said rod members through said perimeter member securing the same together.

* * * * *